United States Patent [19]

Chubb

[11] 3,981,538

[45] Sept. 21, 1976

[54] RESILIENT PLATFORMS FOR SEATING

[75] Inventor: Anthony Guy Chubb, Naphill, England

[73] Assignee: Pirelli Limited, London, England

[22] Filed: July 31, 1975

[21] Appl. No.: 600,868

[52] U.S. Cl. ..... 297/454; 297/457
[51] Int. Cl.[2] ..... A47C 7/02
[58] Field of Search ..... 297/452, 454–457

[56] References Cited

UNITED STATES PATENTS

| | | | |
|---|---|---|---|
| 3,123,395 | 3/1964 | Glass | 297/457 |
| 3,902,756 | 9/1975 | Chubb | 297/452 |

*Primary Examiner*—James C. Mitchell
*Attorney, Agent, or Firm*—Brisebois & Kruger

[57] ABSTRACT

A seat frame comprises a resilient seating platform attached to first, second and third horizontal frame members, the first member being at the front of the seat and at seat level and the second and third members being at the back of the seat and respectively above and below seat level. The resilient platform comprises first sheet means, including a full-width elastic portion, secured along one edge to the first frame member and along an opposite second edge to a second sheet means. The second sheet means comprises a first portion secured along its opposite edges to the second frame member and the second edge of the first sheet means respectively and a second portion secured along its opposite edges to the third frame member and the second edge of the first sheet means respectively. In a modification, the platform comprises a further portion secured along one edge to a line of the first sheet means intermediate the opposite edges of the first sheet means, and along an opposite second edge to a fourth frame member disposed towards the front of the seat and below seat level.

5 Claims, 2 Drawing Figures

RESILIENT PLATFORMS FOR SEATING

BACKGROUND OF THE INVENTION

This invention relates to a seat frame comprising a resilient seating platform attached to horizontal frame members, particularly for domestic furniture.

It is known to provide resilient platforms both in the seat panels and in the back panels of domestic seats, the platforms being attached to a framework which is generally of wood. The attachment of each platform is made, for example, along a pair of opposite edges of the platform. The platforms usually provide bases for the respective seat and back cushions of the furniture. Some known platforms include combinations of elastic and minimum-stretch sheet materials arranged so that the elastic sheet is stretched under tension when the platform is applied to the seat frame. All of these platforms have various disadvantages in that they comprise a large number of sheets and other elements or are time consuming to manufacture and assemble onto the framework or otherwise do not provide a completely satisfactory support when in use. Also, some known platforms require skilled labour and complicated apparatus to manufacture and assemble onto the framework.

Objects of this invention are to provide a seat frame which includes a single resilient platform serving at the same time for the seat proper and back of the seat and comprising relatively few components the platform being simple and quick to manufacture and assemble onto the framework and not requiring skilled labor or complicated apparatus to manufacture and assemble onto the framework.

SUMMARY OF THE INVENTION

As seen from one aspect this invention provides a seat frame comprising:

a. a first horizontal frame member at the front of the frame and at seat level;

b. a second horizontal frame member at the back of the frame and above seat level;

c. a third horizontal frame member at the back of the frame and below seat level; and d. a resilient seating platform attached to said horizontal frame members and comprising:

i. first sheet means having first and second opposite edges, said first sheet means being secured along its said first edge to said first frame member, said first sheet means extending generally horizontally towards the back of the frame and including an elastic portion extending across the full width of said first sheet means; and ii. second sheet means comprising a first portion having first and second opposite edges and a second portion having first and second opposite edges, said first portion being secured along its said first edge to said second frame member and along its said second edge to said second edge of said first sheet means and said second portion being secured along its said first edge to said third frame member and along its said second edge to said second edge of said first sheet means.

As seen from a second aspect this invention provides a seat frame comprising:

a. a first horizontal frame member at the front of the frame and at seat level;

b. a second horizontal frame member at the back of the frame and above seat level;

c. a third horizontal frame member at the back of the frame and below seat level; and d. a resilient seating platform attached to said horizontal frame members and comprising:

i. a sheet of elastic material having first and second opposite edges;

ii. a first sheet of minimum-stretch material having first and second opposite edges and secured along its said first edge to said first frame member and along its said second edge to said first edge of said elastic material sheet;

iii. a second sheet of minimum-stretch material having first and second opposite edges and secured along its said first edge to said second frame member and along its said second edge to said second edge of said elastic material sheet; and iv. a third sheet of minimum-stretch material having first and second opposite edges and secured along its said first edge to said third frame member and along its said second edge to said second edge of said elastic material sheet.

In a modification, the seat frame comprises a fourth horizontal frame member adjacent the front of the frame and below seat level, and in which said platform comprises a fourth sheet of minimum-stretch material having first and second opposite edges and secured along its said first edge to said fourth frame member and along its said second edge to said first edge of said elastic material sheet.

BRIEF DESCRIPTION OF THE DRAWINGS

Embodiments of this invention will now be described, by way of example only, with reference to the accompanying drawings, in which:

Referring to FIG. 1 of the drawings, there is shown a seat frame comprising a tubular metal framework 10 and a resilient platform 12 assembled onto the framework. The seat will be completed by placing a seat cushion, and perhaps also a back cushion, over the platform, but these cushions are for clarity omitted from the drawings.

The framework 10 comprises side frame members **10*a* and 10*b* interconnected by horizontal frame members 10*c*, 10*d*, 10*e*, the first horizontal frame member 10*c* being at the front of the seat at seat level and the second and third such members 10*d* and 10*e* being at the back of the seat respectively above and below seat level. In particular, in the embodiment shown in FIG. 1, the frame members 10*d* and 10*e*** are respectively at the top and bottom of the seat.

The resilient platform 12 comprises a first sheet **12*a* of non-stretch or minimum-stretch material secured along a first edge to the front horizontal frame member 10*c*, and a sheet 12*b* of elastic sheet material secured along a first edge to a second and opposite edge of the first non-stretch sheet 12*a*. A second sheet 12*c* of non-stretch material is secured along a first edge thereof to the upper back frame member 10*d* and along its opposite second edge to the back edge of the elastic sheet 12*b*. A third sheet 12*d* of non-stretch material is secured along a first edge thereof to the lower back frame member 10*e* and along its opposite edge to the back edge of the elastic sheet 12***b*: however, in the particular arrangement shown in FIG. 1 the sheet 12*d* is secured to the elastic sheet 12*b* only indirectly, being secured to the sheet 12*c* along a line close to and parallel to the back edge of the elastic sheet 12*b*.

The non-stretch material of sheets 12*a*, 12*c* and 12*d* may comprise woven fabric, for example of plastics such as polypropylene fibres, or canvas. The elastic sheet 12*b* may comprise rubber and preferably comprises an integral sheet having two plies of rubberised cord fabric, in which the two plies are vulcanised together with the cord fabric cut on the bias and at inclined angles in the respective plies. Such a sheet is described in British patent specification No. 661,487.

Figure 1:
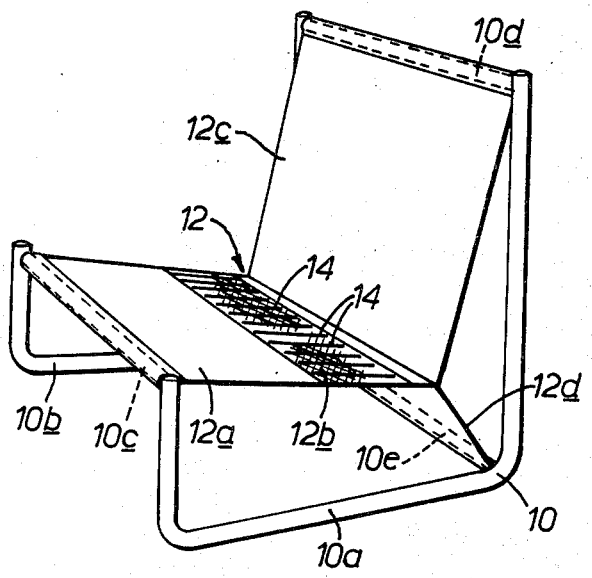
FIG. 1 is a perspective view of a seat frame forming one embodiment of this invention.

In the embodiment shown in FIG. 1, the non-stretch and elastic sheets are secured together by stitching but alternatively may be sewed together by any appropriate means such as by adhesive or stapling. The non-stretch sheets are secured to the frame members by being folded around the frame members and stitched back on themselves, but alternatively they may be secured in place by any appropriate means such as by adhesive or stapling.

The resilient platform is assembled onto the platform such that the elastic sheet 12*b* is stretched and placed under tension. Also, the sheets 12*a* and 12*b* extend generally horizontally at seat level, with a slight incline downwards towards the back of the seat. The sheets 12*c* and 12*d* incline upwards and downwards, respectively, towards the back of the seat from the rear edge of the elastic sheet 12*b*. A plurality of parallel slits 14 is provided in the elastic sheet 12*b* from back-to-front of the seat: the distance between adjacent slits may vary across the width of the seat so as to impart a controlled degree of resilience from side-to-side. Variations in resilience across the width of the seat can also or alternatively be achieved by varying the lengths of the slits.

Figure 2:
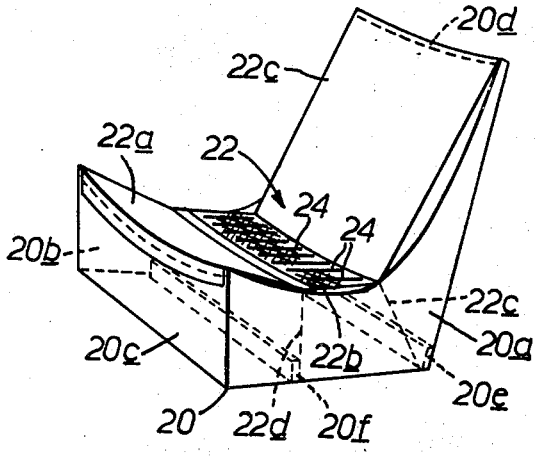
FIG. 2 is a perspective view of a modified seat frame forming a second embodiment of this invention.

Referring now to FIG. 2 of the drawings, there is shown a second embodiment of seat frame, being a modification of the seat frame shown in FIG. 1. The seat frame shown in FIG. 2 comprises a wooden framework 20 and a resilient platform 22. The framework 20 comprises side frame members 20*a* and 20*b* interconnected by four horizontal frame members 20*c*, 20*d*, 20*e* and 20*f*. The first horizontal frame member 20*c* is at the front of the seat with its upper edge at seat level and the second and third members 20*d* and 20*e* are respectively at the top and bottom of the back of the seat. The fourth horizontal frame member 20*f* is at the bottom of the seat and towards the front thereof.

The resilient platform 22 comprises, as for the resilient platform 12 of FIG. 1, an elastic sheet 22*b* and first, second and third non-stretch sheets 22*a*, 22*c* and 22*d* secured between the elastic sheet 22*b* and the frame members 20*c*, 20*d* and 20*e*. The platform comprises a fourth non-stretch sheet 22*d* secured along one edge thereof to the frame member 20*f* and along the opposite edge thereof to the leading edge of the elastic sheet 22*b*. The elastic sheet 22*b* and the non-stretch sheet 22*a* both incline downwards towards the back of the seat, with the elastic sheet much less inclined than the non-stretch sheet 22*a*. The elastic sheet 22*b* is provided with slits 24 as the slits 14 for the platform of FIG. 1 and the elastic sheet is stretched for tension.

The materials for the elastic and non-stretch sheets are as for the same sheets in FIG. 1. The sheets are sewed together in the same way as in FIG. 1. The sheets are secured to the wooden frame members either by stapling or by adhesive.

It will be noted that in each of the Figures, the resilient platform is a single unit providing the shape and suspension which in the prior art is achieved by two separate platforms, one in the seat proper and one in the back of the seat, assembled to respective rectangular wood frames. This enables the frame of the seats in FIGS. 1 and 2 to be simplified relative to the prior art by eliminating at least two frame members or rails. The platform is simple to apply to the seat frame, relative to prior art platforms.

I claim:

1. A seat frame comprising:

a. a first horizontal frame member at the front of the frame and at seat level;

b. a second horizontal frame member at the back of the frame and above seat level;

c. a third horizontal frame member at the back of the frame and below seat level;

d. two spaced rigid side-frame structures between which said horizontal frame members extend; and e. a resilient seating platform attached to said horizontal frame members and comprising:

i. first sheet means having first and second opposite edges, said first sheet means being secured along its said first edge to said first frame member, said first sheet means extending generally horizontally towards the back of the frame and including an elastic portion extending across the full width of said first sheet means; and ii. second sheet means comprising a first portion having first and second opposite edges and a second portion having first and second opposite edges, said first portion being secured along its said first edge to said second frame member and along its second edge to said second edge of said first sheet means and said second portion being secured along its said first edge to said third frame member and along its said second edge to said second edge of said first sheet means.

2. A seat frame as claimed in claim 1, comprising a fourth horizontal frame member adjacent the front of the frame and below seat level, and in which said platform comprises a further portion having first and second opposite edges which portion is secured along its said first edge to said fourth frame member and along its said second edge to said first sheet means along a line intermediate but parallel to said first and second opposite edges of said first sheet means.

3. A seat frame as claimed in claim 2, in which said elastic portion of said first sheet means is disposed between said second edge thereof and said second edge of said further portion.

4. A seat frame comprising:

a. a first horizontal frame member at the front of the frame and at seat level;

b. a second horizontal frame member at the back of the frame and above seat level;

c. a third horizontal frame member at the back of the frame and below seat level;

d. two spaced rigid side-frame structures between which said horizontal frame members extend; and e. a resilient seating platform attached to said horizontal frame members and comprising:

i. a sheet of elastic material having first and second opposite edges;

ii. a first sheet of minimum-stretch material having first and second opposite edges and secured along its said first edge to said first frame member and along its said second edge to said first edge of said elastic material sheet;

iii. a second sheet of minimum-stretch material having first and second opposite edges and secured along its said first edge to said second frame member and along its said second edge to said second edge of said elastic material sheet; and iv. a third sheet of minimum-stretch material having first and second opposite edges and secured along its said first edge to said third frame member and along its said second edge to said second edge of said elastic material sheet.

5. A seat frame as claimed in claim 4 comprising a fourth horizontal frame member adjacent the front of the frame and below seat level, and in which said platform comprises a fourth sheet of minimum-stretch material having first and second opposite edges and secured along its said first edge to said fourth frame member and along its said second edge to said first edge of said elastic material sheet.

* * * * *